United States Patent [19]

Gregory, III

[11] 4,355,554

[45] Oct. 26, 1982

[54] WEB SECTIONING APPARATUS INCLUDING AN INTERFERENCE INDICATOR

[75] Inventor: Joseph L. Gregory, III, Richmond, Va.

[73] Assignee: Philip Morris Incorporated, New York, N.Y.

[21] Appl. No.: 195,759

[22] Filed: Oct. 10, 1980

[51] Int. Cl.[3] ..... B26D 1/40; B26D 7/26

[52] U.S. Cl. ..... 83/37; 83/72; 83/344; 83/346; 83/522; 33/185 R

[58] Field of Search ..... 83/522, 344, 346, 347, 83/349, 62, 72, 37; 33/182, 185 R, 186; 73/593; 116/233

[56] References Cited

U.S. PATENT DOCUMENTS

| | | | |
|---|---|---|---|
| 3,276,306 | 10/1966 | Winkler et al. | 83/346 X |
| 3,554,012 | 1/1971 | Söhoel | 73/593 X |
| 3,744,361 | 7/1973 | Van Doorn et al. | 83/522 X |
| 3,903,609 | 9/1975 | Brown | 33/185 R |
| 4,130,042 | 12/1978 | Reed | 83/344 X |
| 4,252,023 | 2/1981 | Pomernacki | 73/593 |

*Primary Examiner*—Frank T. Yost

*Attorney, Agent, or Firm*—Arthur I. Palmer, Jr.

[57] ABSTRACT

A web sectioning apparatus wherein web sectioning occurs through engagement or interference of the cutting edges of a rotatable knife assembly with the surface of a drum and wherein an indicator is provided for generating a signal indicative of the force resulting from such interference.

20 Claims, 5 Drawing Figures

52
90
88
16
56
86
92
94
84
80
82
78
70
76
72
74
26
68
66
68
68
10
12

WEB SECTIONING APPARATUS INCLUDING AN INTERFERENCE INDICATOR

BACKGROUND OF THE INVENTION

This invention relates to apparatus for sectioning a continuous web of material.

Prior web sectioning apparatus constructions are disclosed in U.S. patent application Ser. No. 941,497, now abandoned and U.S. patent application Ser. No. 967,782, filed Sept. 11, 1978 and Dec. 8, 1978, respectively, and assigned to the same assignee hereof. In the apparatus described in such prior copending applications, the web to be sectioned is carried by a rotatable drum whose axis is parallel to the axis of a rotatable drum whose axis is parallel to the axis of a rotatable knife assembly. The cutting edges of the knife assembly extend parallel to the axis of the knife assembly and repetitively engage the drum, thereby cutting the web along lines transverse to its direction of elongation. Such apparatus is frequently used for sectioning cigarette tipping paper. The apparatus of the '782 application further provides for precise adjustment of the position of each cutting edge relative to the axis of rotation of the knife assembly.

A further improvement over the aforesaid constructions is described in commonly assigned U.S. Pat. No. 4,308,776, which issued Jan. 5, 1982, on application Ser. No. 143,812, filed May 23, 1980. The apparatus described in the '776 patent allows for adjusting the degree of engagement or interference and, therefore, the engagement or interference force, between the cutting edges and the surface of the drum by precisely and repeatedly moving the axis of rotation of the knife assembly towards or away from the drum. This is accomplished by providing a frame for rotatably supporting the knife assembly and by mounting the frame to a housing so that it can be pivoted about an axis parallel and eccentric to the drum axis. Precise pivoting of the frame by an incrementally adjustable mechanism allows precise movement of the knife assembly with its cutting edges toward or away from the drum. Small incremental variations in the cutting edge-drum interference can, therefore, be made resulting in more accurate adjustment of same.

While the apparatus of the above copending applications and the '776 patent have provided a measure of improvement in conventional web sectioning machines, setting of the cutting edge-drum interference is still based solely on the judgment of the machine operator. Improper adjustment by the operator can result in failure to cleanly cut the web (this can occur if the interference is set too low) or in a rapid dulling of the cutting edges and scoring of the drum (this can occur if the interference is set too high), whereby excessive downtimes and increased costs are encountered.

It is an object of the present invention to provide a web sectioning apparatus which is free of the aforesaid disadvantages.

It is a further object of the invention to provide a web sectioning apparatus wherein knife and drum wear and machine downtime are reduced.

SUMMARY OF THE INVENTION

In accordance with the principles of the present invention, the above and other objectives are realized in a web sectioning apparatus comprising a rotatable drum, a rotatable knife assembly having cutting edges for repetitively engaging the drum upon rotation of the knife assembly and drum and an indicator means for providing an indication of the force resulting from the engagement or interference between the cutting edges and drum. With the aforesaid indicator means included in the web sectioning apparatus, the operator now has a positive means for assessing the cutting edge-drum interference level and, therefore, can now adjust the level based on the indicator to bring the level within desired limits. Accurate and precise adjustment is thus now possible.

The indicator means of the invention comprises a force sensor which can take on various forms as long as the sensor is capable of providing an output signal from which cutting edge-drum interference forces can be discerned. Possible sensors are vibration sensors, strain gauges and piezoelectric crystals, the latter two being preferable. The sensor is suitably mounted to the apparatus and its output signal is applied to a display which can be observed by the operator to assess the condition of the interference. Such display might comprise one or more lamps which are adapted to light when the interference force is below, above or within certain preselected levels.

In the illustrative embodiment of the invention to be discussed hereinbelow, the web sectioning apparatus is further assembled in accordance with the '776 patent construction.

BRIEF DESCRIPTION OF THE DRAWINGS

The above and other features and aspects of the present invention will become more apparent upon reading the following detailed description in accordance with the accompanying drawings, in which.

DETAILED DESCRIPTION

Figure 1:
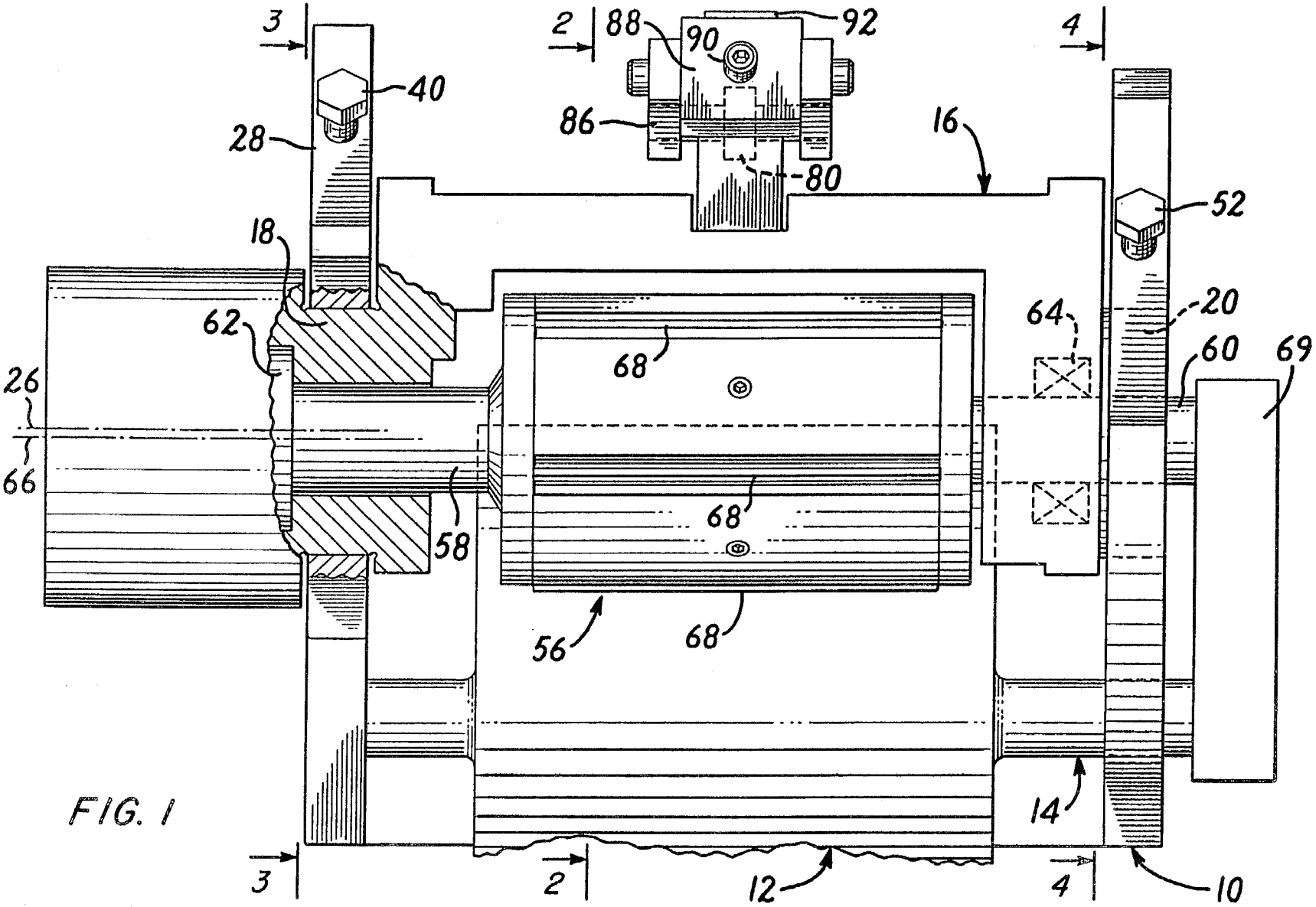
FIG. 1 is an end elevational view of a web sectioning apparatus provided with an indicator means in accordance with the principles of the present invention.
Figure 2:
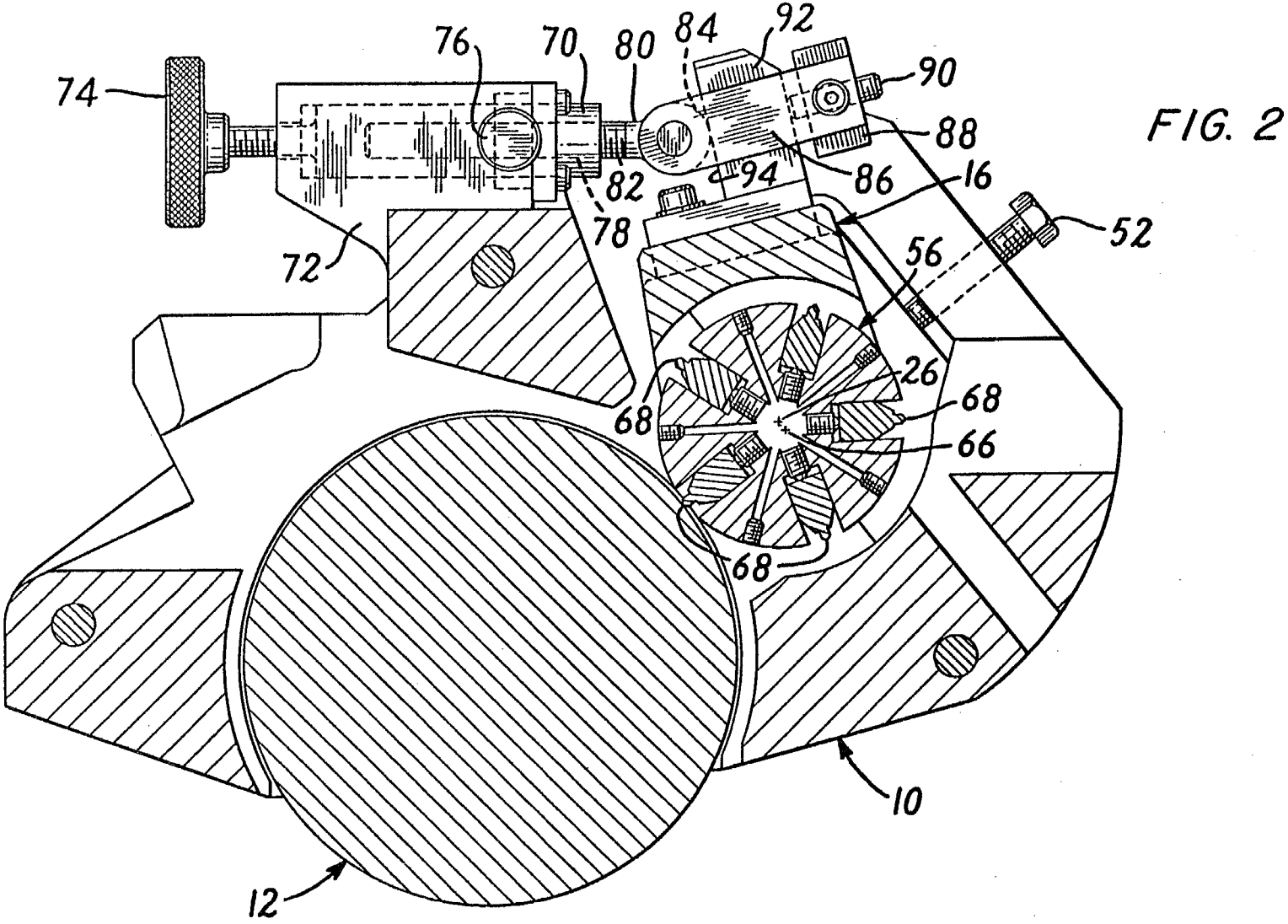
FIG. 2 is a sectional view taken on line 2—2 in FIG. 1.

As shown in FIGS. 1 and 2, the web sectioning apparatus includes a housing 10 and a cylindrical drum 12 rotatably mounted to the housing by means of a shaft 14 and bearings (not shown). A frame 16 is provided with first and second cylindrical journals 18 and 20 (FIG. 1), these journals being received in respective first and second concave, semi-cylindrical bearing surfaces 22 (FIG. 3) and 24 (FIG. 4) of the housing 10. The bearing surfaces 22 and 24 are coaxial with one another, as are the journals 18 and 20 of the frame 16. Thus, the journals and the bearing surfaces serve to cooperatively mount the frame 16 to the housing 10 for pivoting motion about an axis 26. The axis 26 is parallel to the axis of the drum 12.

Figure 3:
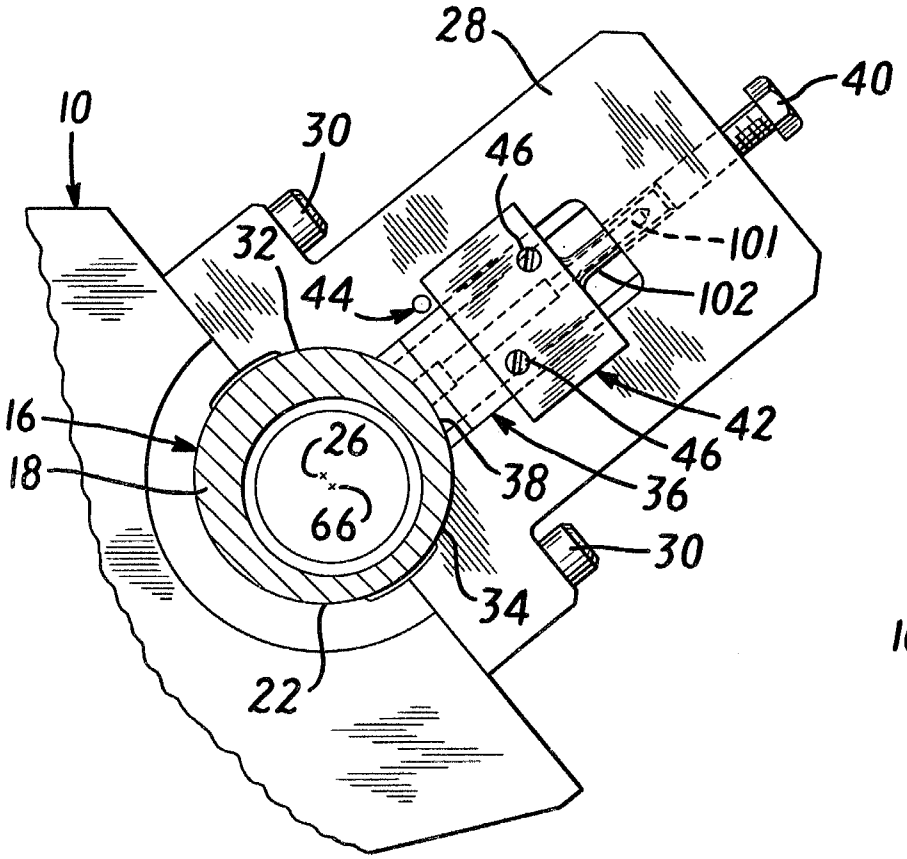
FIG. 3 is a fragmentary sectional view taken on line 3—3 in FIG. 1 and showing a first force sensor utilized as an indicator means in accordance with the invention.

As shown in FIG. 3, a clamp plate 28 is removably mounted to the housing 10 by a pair of screws 30. The plate 28 defines portions 32 and 34 of a further semicylindrical bearing surface. The surfaces 32, 34 and 22 provide a free running fit with the first journal 18 of the frame 16. A block 36 is slidably mounted to the clamp plate 28, and is thus slidably mounted to the housing 10. The lower end of the block 36 overlies the journal 18. A jack bolt 40 is threadedly engaged with the clamp plate 28; the lower end of the jack bolt 40 bears upon the upper end of the block 36. Thus, by tightening the jack bolt 40, the block 36 may be forced toward the bearing surface 22 of the housing and toward the drum (downwardly and to the left as seen in FIG. 3). A lock plate 42 is mounted to the block 36 by means of screws 46 extending through the lock plate 42 into the block 36, or integrally fabricated into the block 36. The lock plate 42 and block 36 are retained from falling out of the slide of clamp plate 28 by pin 44. Pin 44 is pressed into a hole in the clamp plate 28.

Figure 4:
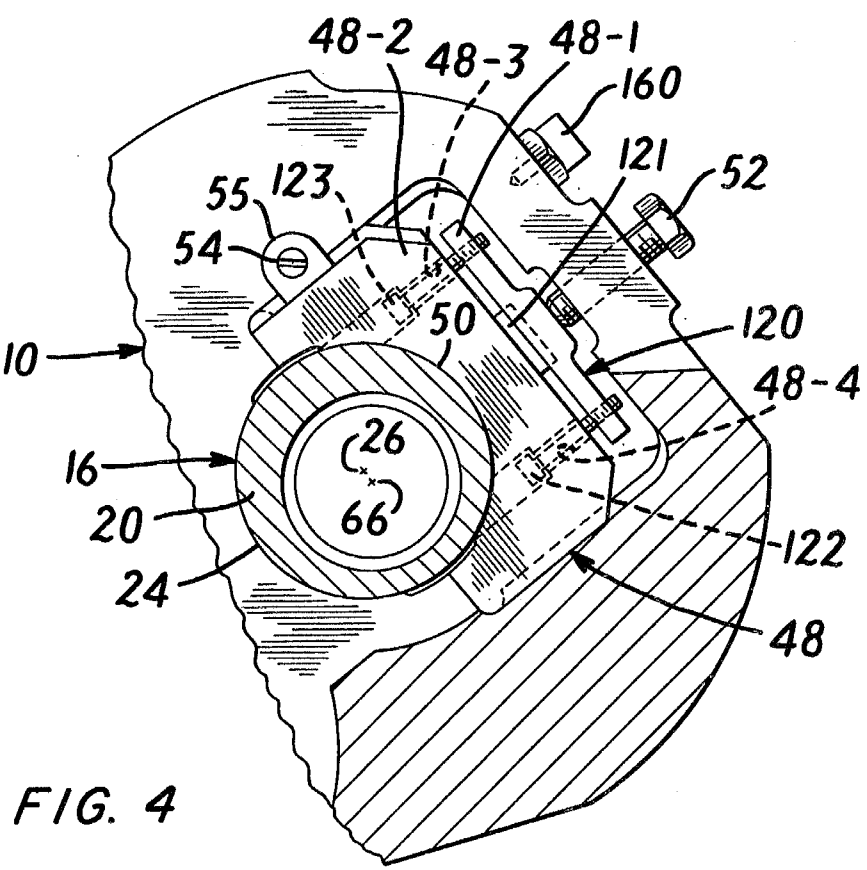
FIG. 4 is a fragmentary sectional view taken on line 4—4 of FIG. 1 and showing second and third force sensors utilized as an indicator means in accordance with the invention.

As seen in FIG. 4, a second block 48 is slidably mounted to the housing adjacent to the second bearing surface 24. The second block 48 has a concave semicylindrical surface 50 which overlies the second journal 20. A second jack bolt 52 is threadedly engaged with the housing 10; by tightening this second jack bolt 52, the second block 48 may be forced toward the second bearing surface 24 and toward the drum (downwardly and to the left as seen in FIG. 4). A gib screw 54 attaches a restraining washer 55 which bears against the block 48 and fixes its position relative to the housing 10. This gib screw 54 is threadedly engaged in the housing 10.

The blocks 36 and 48 are arranged to force the journals toward the bearing surfaces on a line of action which extends through the axis of the bearing surfaces and the axis of the drum.

As seen in FIG. 1, a knife assembly 56 is mounted to the frame 16 between the journals 18 and 20 by means of stub shafts 58 and 60 and anti-friction bearings 62 and 64. Although the axis of rotation 66 of the knife assembly with respect to the frame 16 is parallel to the axis 26 of the journals 18 and 20, the axis 66 is eccentric with respect to the axis 26. The axis of rotation 66 of the knife assembly with respect to the frame 16 lies beneath the axis 26 of the journals and bearing surfaces. Thus, as best appreciated with reference to FIGS. 3 and 4, clockwise pivoting of the frame 16 on the bearing surfaces 22 and 24 (i.e., on the axis 26) will move the axis of rotation 66 of the knife assembly 56 downwardly and to the left. As seen in FIG. 2, such motion of the axis 66 will bring it closer to the drum 12.

As seen in FIGS. 1 and 2, the knife assembly 56 is provided with a plurality of cutting edges 68 which extend parallel to the axis of rotation 66 of the knife assembly 56. During operation of the apparatus, the knife assembly 56 is rotated counterclockwise and the drum 12, carrying a web of material (not shown), is rotated clockwise by an appropriate drive means 69 (FIG. 1). Such rotation causes the cutting edges 68 of the knife assembly 56 to engage the surface of the drum 12 and part the web. As will be readily appreciated with reference to FIG. 2, the closer the axis 66 is to the axis of the drum 12, the more heavily the cutting edges 68 will engage the surface of the drum 12. Preferably, the knife assembly 56 is of the type described in the aforementioned U.S. patent application Ser. No. 967,782.

As seen in FIG. 2, a control element 70 is rotatably mounted to an upward extension 72 of the housing 10. A knob 74 is fixed to an extension of the control element 70 so that the control element may be manually rotated. A detent 76 is provided to prevent unintentional rotation of the control element 70. The control element 70 has internal helical threads 78 concentric with its axis of rotation. A link 80 having external helical threads 82 is threadedly engaged with the control element 70. The link 80 has a cylindrical cam surface 84 at its right hand end. A shackle 86 is pivotally mounted to the link 80 on an axis concentric with the axis of cam surface 84. A shackle end plate 88 is fixed to the end of the shackle 86 remote from the link 80. A set screw 90 is threadedly engaged with the shackle end plate 88.

An arm 92 extends upwardly from the frame 16 between the shackle end plate 88 and the cam surface 84 of the link 80. Thus, the set screw 90 serves to maintain the front surface 94 of the arm in contact with the cam surface 84 of the link 80. As will be appreciated with reference to FIGS. 1 and 2, the arm 92 extends transversely of the axis 26 of the bearing surfaces and journals 18 and 20. By rotating the control element 70, the link 80 (FIG. 2) may be controllably moved transversely of the arm 92.

The degree of engagement or interference of the cutting edges 68 with the drum 12 may be adjusted in the following manner: first, the clamp screws 46 (FIG. 3) and the gib screw 54 (FIG. 4) are loosened, and the jack bolts 52 and 40 are backed off to disengage the blocks 48 and 36 from the journals 18 and 20. The surface 32 and 34 of the clamp plate 28 will retain the frame 16 in pivotable but close engagement with the first bearing surface 22 even when the block 36 is disengaged from the journal 18. Likewise, the second block 48 is preferably only slightly retracted from the journal 20 so that the journal 20 is also maintained in pivotable but close engagement with the second bearing surface 24.

The control element 70 is rotated by means of the knob 74 to move the link 80 to the right or to the left as seen in FIG. 2. Such movement of the link 80 will cause the frame 16 to pivot about the axis 26 on the bearing surfaces 24 and 22. The pivoting motion of the frame 16 on the axis 26 will move the axis of rotation 66 of the knife assembly 56 towards or away from the drum 12. Thus, if the link 80 is moved to the right as seen in FIG. 2, the frame 16 will pivot clockwise and the axis of rotation 66 will be moved closer to the drum 12 so that the cutting edges 68 will be more heavily engaged with the drum surface when the apparatus is later operated. Of course, movement of the link 80 to the left will have the opposite effect.

After the frame 16 has been pivoted to achieve the desired adjustment, the jack bolts 40 and 52 are tightened to force the blocks 36 and 48 (FIGS. 3 and 4) towards the drum 12. The first block 36 will engage the first journal 18 and force it tightly against the first bearing surface 22. Likewise, the second block 48 (FIG. 4) will engage the second journal 20 and force it tightly against the second bearing surface 24.

As will be readily appreciated, the forceful engagement of the blocks 36 and 48 with the journals 18 and 20 and of the journals 18 and 20 with the bearing surfaces 22 and 24 prevents any pivotal or linear movement of the frame 16 with respect to the housing 10 during operation.

The eccentricity or distance between the axis of rotation 66 and the axis 26 as seen in the drawings has been greatly exaggerated in the drawings for purposes of illustration. In actual practice, this distance is preferably only about 0.060 inch. Thus, the axis of rotation 66 of the knife assembly 56 would be moved at most about 0.120 inch towards or away from the drum surface by a 180° pivoting motion of the frame 16 relative to the housing 10. Of course, the small pivoting motion produced by incremental motion of the link 80 will produce an even smaller motion of the axis of rotation 66. Preferably, the distance of the link 80 from the axis 26, the pitch of the threads 82 and 78 on the link 80 and the control element 70, and the eccentricity between the axes 26 and 66 are chosen so that one half revolution of the knob 74 will correspond to about three ten thousandths of an inch movement of the axis of rotation 66.

The description of the web sectioning apparatus to this point has followed that of the above-mentioned '766 patent. While the apparatus, as described, permits small incremental movements of the axis of rotation 66 of the knife assembly 56 and, therefore, the cutting edges 68, relative to the drum 12 to thereby either increase or decrease the degree of engagement or interference therebetween, the apparatus is devoid of any means for allowing the operator to set the interference at a level which will ensure acceptable cutting as well as prevent excessive wear of the cutting edges 68 and scoring of the drum 12. In normal practice, the operator initially runs the apparatus to section representative lengths of web. If the web lengths are not cleanly cut, the operator goes through the previously discussed procedure for setting the interference by rotation of the control knob 74, the amount of rotation being based upon what the operator believes would result in a clean cut. After setting is complete further lengths of web are sectioned by again running the apparatus, and the cut lengths are examined. If acceptable, the apparatus is ready for continuous operation. If not, the procedure is repeated until a setting is obtained at which cutting is acceptable. During operation, the aforesaid procedure is repeated each time the cutting edges 68 wear to a point where they no longer provided an acceptable cut.

As can be appreciated, adjustment of the apparatus as above-described is time consuming and can result in long downtimes in apparatus operation. Furthermore, since setting of the interference is dependent upon operator experience and is primarily based upon obtaining a clean cut, there is no assurance that the interference will be at a level which also will prevent excessive cutting edge wear. Additionally, there is no assurance that excessively worn cutting edges 68 will not continue to be used at interference levels which could cause damage to the drum 12.

Accordingly, the described web sectioning apparatus is further provided with an indicator which provides a signal indicative of the force resulting from the engagement or interference between the cutting edges 68 and the drum 12. With such an indicator and following the aforementioned procedure, the operator can now quickly set the interference force for the knife assembly 56 at the minimum level required for obtaining a clean cut. Excessive blade wear will thus be avoided. Furthermore, the operator can now ascertain when the interference level is such that it will cause grooving of the drum 12 and/or excessive loading, vibration or noise. At this point, the operator will realize that the cutting edges 68 of the knife assembly 56 should be replaced, as opposed to further increasing the interference level.

Figure 5:
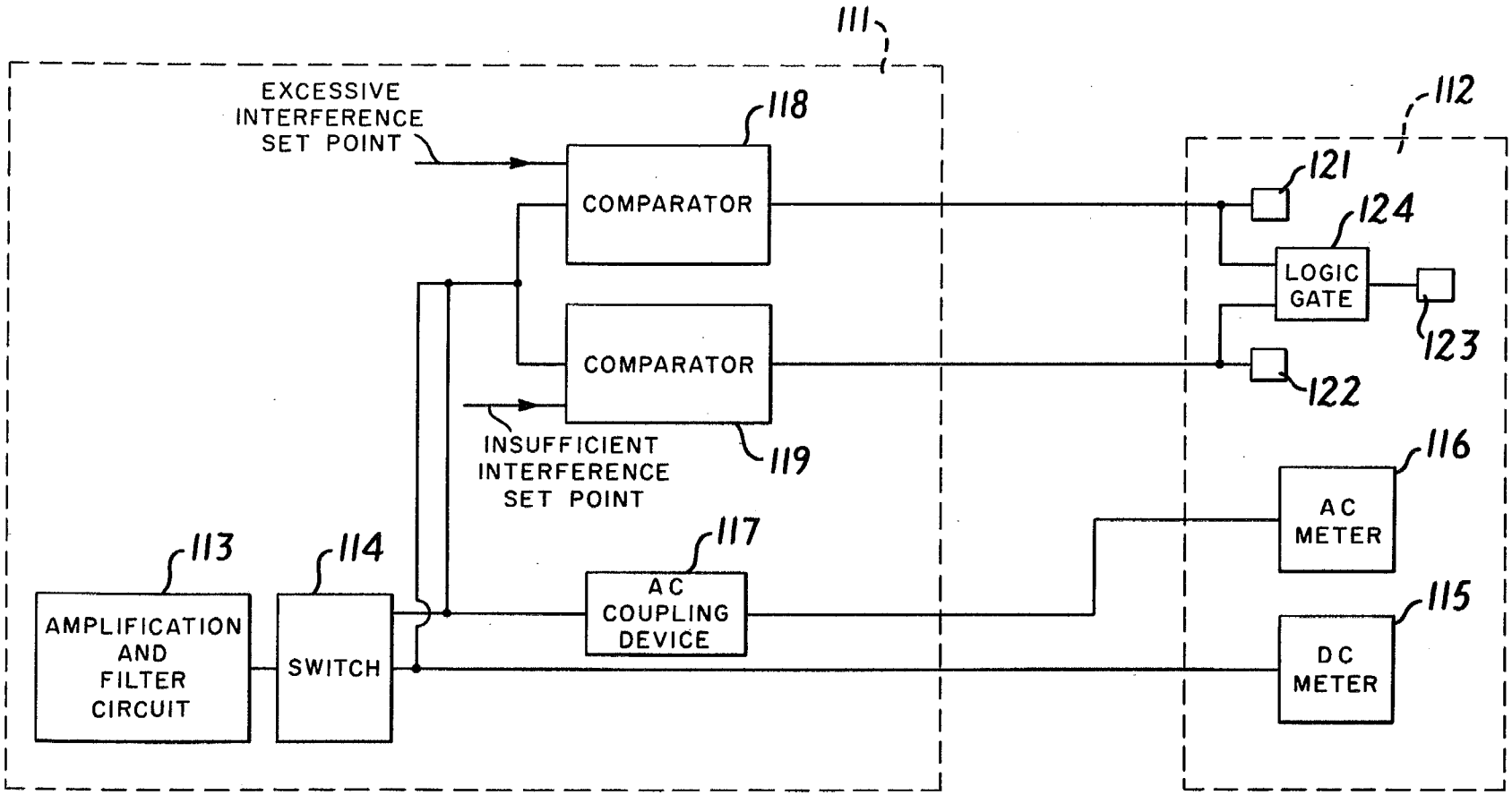
FIG. 5 is a block diagram of processing and display equipment forming part of the indicator means of the invention.

FIG. 3 shows one type of force sensor for realizing an indicator in accordance with the principles of the invention. The sensor is in the form of a strain gauge 101 which is disposed in a central bore 102 of the block 36, the latter bore 102 opening out of the block 36 toward journal 18. In this position, the strain gauge 101 is responsive to the force between the block 36 and the journal 18, the latter force, in turn, being indicative of the static clamping force being applied by the jack bolt 40 during static conditions and being further indicative of the interference level or force during dynamic operation. The strain gauge 101 converts this force to an electrical signal which, as is illustrated schematically in FIG. 5, is suitably processed in a processing circuit 111 and coupled therefrom to a display 112, the latter display being situated on a part of the apparatus observable to an operator. The operator can thus observe the interference level and take appropriate action based thereon.

Typically, the processing circuit 111 might comprise a suitable conditioning and amplification circuit 113 whose output is provided to a switch 114 which permits the signal to be coupled to a DC meter 115 for measurement during static conditions and to an AC meter 116, via AC coupling device 117, for continuous measurement during dynamic conditions. During both types of conditions, the switch 114 further couples the signal to first and second comparators 118 and 119. The first comparator 118 compares the signal to a first set point indicative of excessive interference and the other comparator 119 to a second set point indicative of insufficient interference. Comparator 118 provides an output if its set point is exceeded, and comparator 119, if its set point is not exceeded. The comparator outputs are applied to lamps 121 and 122 in the display 112 and to a further lamp 123 via a logic gate 124 which develops an output only when both comparators have no output.

As can be appreciated, the lighting of lamp 123 will indicate to an operator that the interference is at a level sufficient to provide acceptable cutting but not such as to cause drum damage. The off condition of lamp 123 and the on condition of lamp 122, on the other hand, will indicate that the interference level is insufficient to provide acceptable cutting. In such case, the operator can adjust, via the knob 74 and the clamps 28 and 48, the position of knife assembly 56 so that the interference level is raised to the point where the lamp 122 just goes off and the lamp 123 just goes on, indicating the minimum interference level for acceptable cutting. Finally, if the lamp 123 is off and the lamp 121 is on, the operator will recognize that an excessive interference level has been reached and that the cutting edges 68 of the knife assembly 56 should be replaced.

While the comparators 118 and 119 and lamps 121–123 provide the operator with relative information regarding the level of interference, the meters 115 and 116 provide the operator with a continuous measure thereof. In this regard, the display 112 also can include an oscilloscope or similar unit for providing an observable trace of the interference.

FIG. 4 shows a second type of force sensor 120 usable as an indicator in accordance with the invention. The sensor 120 comprises a piezoelectric crystal 121 which is mounted between a pressure plate section 48-1 and a main section 48-2 of the block 48. The pressure plate 48-1 houses the crystal 121 and is held spaced from the section 48-2 by the crystal projection. The plate 48-1 is loosely positioned laterally and is retained between section 48-2 and housing 10 by suitably threaded bolts 122 and 123 mounted in bores 48-3 and 48-4 of the section 48-2. The bolt 52 applies pressure to the block 48 through bearing on the plate 48-1, this pressure being, in turn, coupled to the section 48-2 through the crystal 121. The crystal 121 is responsive to the force between the block 48 and the journal 20, this force being indicative of the static clamping force during static conditions and being further indicative of the interference level during dynamic operation. The crystal 121 develops an electrical signal corresponding to such force and this signal can be used in the same manner as discussed above for the strain gauge signal to provide a suitable indication of the interference level.

FIG. 4 also shows a further force sensor which can be used as an indicator in accordance with the invention, this sensor being a vibration transducer 160 such as, for example, an accelerometer or seismic pickup. In this case, the sensor 160 is mounted on the housing 10 and senses vibrations which again are influenced by the interference force between the cutting edges 68 and the drum 12. The output of such a sensor can be processed and used to display interference level conditions in a manner similar to that described previously in connection with the other two sensors.

In all cases it is understood that the above-described arrangements are merely illustrative of the many possible specific embodiments which represent applications of the present invention. Numerous and varied other arrangements can readily be devised in accordance with the principles of the present invention without departing from the spirit and scope of the invention. Thus, for example, the mounting of the above-described sensors might be other than as illustrated as long as the mounting causes the sensor to be in force coupling relationship to the drum-cutting edge interference force. Additionally, the comparators 118 and 119 can be adapted to have variable set points so as to enable operation over variable interference ranges.

What is claimed is:

1. Web sectioning apparatus comprising:

a rotatable drum;

a rotatable knife assembly, said knife assembly including a cutting edge repetitively engagable with said drum upon rotation of said knife assembly and said drum, whereby a web carried by said drum may be sectioned during each such engagement;

indicator means responsive to the engagement of said cutting edge and said drum for providing an indication of the force resulting from said engagement, said indicator means including:

a force sensor for providing a signal indicative of said engagement force; and processing and display means responsive to said signal for providing an observable display, said processing and display means including first and second comparators responsive to said signal and to first and second predetermined signals respectively indicative of first and second preselected engagement forces, and first, second and third lamps responsive to said first and second comparators.

2. Apparatus in accordance with claim 1 wherein:

said first comparator provides an output when said signal is below said first predetermined signal;

said second comparator provides an output when said signal is above said second predetermined signal;

and said first and second lamps light when said first and second comparators provide outputs, respectively.

3. Apparatus in accordance with claim 2 wherein:

said display and processing means further includes means for coupling said first and second comparators to said third lamp such that said third lamp lights only when both said comparators provide no output.

4. Web sectioning apparatus comprising:

a rotatable drum;

a rotatable knife assembly, said knife assembly including a cutting edge repetitively engageable with said drum upon rotation of said knife assembly and said drum, whereby a web carried by said drum may be sectioned during each such engagement;

indicator means responsive to the engagement of said cutting edge and said drum for providing an indication of the force resulting from said engagement, said indicator means including a force sensor for providing a signal indicative of said engagement forces; and a support carrying said knife assembly, said support comprising:

a housing having first and second coaxial bearing surfaces;

a frame having first and second coaxial journals, said first and second journals being receivable on said first and second bearing surfaces, respectively, and said knife assembly being rotatably mounted to said frame; and clamp means for forcing said first and second journals against said first and second bearing surfaces to secure said frame to said housing, said clamp means being operable to release said journals;

and said force sensor being held by said clamp means.

5. Apparatus in accordance with claim 4 wherein:

said clamp means includes a first block slidably mounted to said housing, said first block overlying said first journal; and a first means for selectively forcing said first block toward said first bearing surface;

and said indicator means is engaged by said first block.

6. Apparatus in accordance with claim 5 wherein:

said block includes a bore opening toward said first bearing surface;

and said indicator means includes a strain gauge disposed within said bore.

7. Apparatus in accordance with claim 6, wherein the rotation axis of said knife assembly is eccentric to the axis of said journals.

8. Apparatus in accordance with claim 7, further comprising movement mean for controllably pivoting said frame on said bearing surfaces when said journals are released to adjust the degree of engagement between said cutting edge and said drum.

9. Apparatus in accordance with claim 5 wherein:

said clamp means further includes a plate spaced above and fixed to said block;

and said indicator means includes a piezoelectric crystal held between said block and said plate.

10. Apparatus in accordance with claim 9, wherein the rotation axis of said knife assembly is eccentric to the axis of said journals.

11. Apparatus in accordance with claim 10, further comprising movement means for controllably pivoting said frame on said bearing surfaces when said journals are released to adjust the degree of engagement between said cutting edge and said drum.

12. Apparatus in accordance with claim 5, wherein:

the rotation axis of said knife assembly is eccentric to the axis of said journals.

13. Apparatus in accordance with claim 12 further comprising:

movement means for controllably pivoting said frame on said bearing surfaces when said journals are released to adjust the degree of engagement between said cutting edge and said drum.

14. Apparatus in accordance with claim 1 or 4 wherein:

said indicator means comprises a vibration transducer.

15. Apparatus in accordance with claim 1 or 4 wherein:

said indicator means comprises a strain guage.

16. Apparatus in accordance with claim 1 or 4 wherein:

said indicator means comprises a piezoelectric crystal.

17. A method for sectioning a web, said method comprising the steps of:

rotating a drum;

rotating a knife assembly including a cutting edge to cause said cutting edge repetitively to cooperate with said rotating drum to section a web carried by said drum during each such cooperation;

sensing the force between said rotating drum and said knife assembly during each such cooperation;

providing a signal indicator of said force;

comparing said signal with each of two other signals respectively representative of upper and lower values between which it is desired said force should remain; and providing a visual indication of whether said force exceeds said upper value, lies between said values, or falls below said lower value.

18. A method in accordance with claim 17 wherein: said sensing is carried out with a vibration transducer.

19. A method in accordance with claim 17 wherein: said sensing is carried out with a strain gauge.

20. A method in accordance with claim 17 wherein: said sensing is carried out with a piezoelectric transducer.

* * * * *